United States Patent [19]

Havette

[11] Patent Number: 4,916,280

[45] Date of Patent: Apr. 10, 1990

[54] FOOD PACKAGE ADAPTED PARTICULARLY FOR MICROWAVE HEATING

[75] Inventor: Bernard Havette, Bresles, France

[73] Assignee: Nestec S.A., Vevey, Switzerland

[21] Appl. No.: 209,885

[22] Filed: Jun. 22, 1988

[30] Foreign Application Priority Data

Jul. 11, 1987 [EP] European Pat. Off. ..... 87110045

[51] Int. Cl.[4] ..... H05B 6/80; B65D 81/34

[52] U.S. Cl. ..... 219/10.55 E; 219/10.55 F; 99/DIG. 14; 206/45.21; 426/107; 426/113; 426/234; 426/243; 229/903

[58] Field of Search ..... 219/10.55 E, 10.55 F, 219/10.55 R; 99/DIG. 14; 206/45.2, 45.21; 426/241, 243, 234, 107, 110, 111, 113, 114; 229/902, 903, 905, 906

[56] References Cited

U.S. PATENT DOCUMENTS

| | | | |
|---|---|---|---|
| 2,993,633 | 7/1961 | Keller | 206/45.21 |
| 3,071,307 | 1/1963 | Keller | 206/45.21 |
| 4,260,060 | 4/1981 | Faller | 426/113 X |
| 4,439,656 | 3/1984 | Peleg | 219/10.55 E |
| 4,477,705 | 10/1984 | Danley et al. | 219/10.55 E |
| 4,481,392 | 11/1984 | Nibbe et al. | 99/DIG. 14 |
| 4,612,431 | 9/1986 | Brown et al. | 219/10.55 E |
| 4,795,649 | 1/1989 | Kearns et al. | 426/243 |

*Primary Examiner*—Philip H. Leung
*Attorney, Agent, or Firm*—Vogt & O'Donnell

[57] ABSTRACT

A food package, which is particularly useful for preparation of a food contained in the package by microwave heating, is embodied by a container for the food and by a cover. The cover is made of material which is transparent to microwaves and is removably connected to the container and provides a receptacle adjacent a first surface of the container for containing and for surrounding a second surface opposite the first surface with a fluid which absorbs microwaves.

20 Claims, 3 Drawing Sheets

FOOD PACKAGE ADAPTED PARTICULARLY FOR MICROWAVE HEATING

BACKGROUND OF THE INVENTION

This invention relates to a pack for food products comprising a metal container and a removable cover adapted to the container.

Food products of the frozen prepared dishes type are generally presented in metal containers, for example of aluminium. The containers are closed by a lid, for example of aluminium foil or cardboard, and accommodated in a cardboard pack. To cook or reheat the product, the lid is removed and the container is placed in an oven. Other culinary products, intended for example for the easy preparation of flans, pies or tarts based on baked custard, salted or sweetened, may be formed by a precooked pastry base already in place in a metal container and by a bag containing ingredients making up the filling, for example in dehydrated form. To prepare the dish, the housewife merely has to add the necessary quantity of liquid, for example milk and egg, preferably mixed beforehand, to the dehydrated ingredients and then to cook the product in the oven. The metal containers are perfectly suitable for conventional convection or infrared ovens, but have serious disadvantages for microwave ovens.

The rapid progress in the sale of domestic microwave ovens and the development of industrial catering have brought changes in the conditions under which prepared dishes are made, creating both advantages and problems. The advantages are obvious and are associated with the rapid heating by microwaves which makes the frozen products, for example, even more convenient to use, however, there are several problems in that:

The traditional metal container is opaque to microwave radiation and is unsuitable for microwave ovens because arcing can occur in the oven cavity, which can damage the walls of the oven, or radiation can be reflected towards the magnetron which can thus be damaged if inadequately protected, as for example in ovens of relatively old design.

The cooking of certain products is very uneven because the metals in the form of a conductive foil are not transparent to microwaves and heating takes place downwards. Accordingly, the upper layer is preferentially exposed to the effect of the microwaves, which have only a weak penetrating power, with excessive generation of heat and evaporation of water. In the case of deep-frozen products in particular, this results in uneven cooking with the bottom layer cold, and even still frozen, while the upper layer is dry, or even burnt. In the specific case of the preparation of a baked custard, the use of a microwave oven leads to a movement of the product, preventing correct coagulation of the baked custard. Instead of being smooth, the texture of the baked custard is more like that of scrambled eggs.

Cooking is not only uneven, it is also slow.

Certain development work in the packaging industry in association with microwave cooking has dealt with the problems involved in the selective cooking of multicomponent meals in which the individual components of the meal require different quantities of microwave energy.

For example, U.S. Pat. No. 3,865,301 describes a container formed with apertures which is adapted to several ingredients of a food product of the sandwich type which have to be heated or cooked to different degrees. The container in question is opaque to microwave radiation except for the apertures which are transparent to microwaves.

U.S. Pat. No. 4,081,646 shows a container consisting of a material which is transparent to microwaves and comprising several compartments, a cover made of a material transparent to microwaves and adapted to the container and an apertured box having walls opaque to microwaves and apertures in predetermined positions into which the container and the cover are inserted so that the quantity of radiation received by each of the individual components of the meal may thus be controlled.

Other work has concentrated on the production of containers which are designed to allow both uniform regeneration or cooking and protection of the materials involved, for example cardboard or plastics, in domestic or microwave ovens equipped with infrared grills. For example, U.S. Pat. No. 4,351,997 describes a container of a material transparent to microwave radiation of which the inner surface of the side wall or the corners and the upper part thereof forming the horizontal edge are covered with a metallic material which is opaque to microwaves. A container such as this is difficult to manufacture.

Finally, U.S. Pat. No. 4,439,656 relates to a utensil of a material transparent to microwaves in which a metal container is placed and which, after filling with water, enables the microwave oven to be protected and a food to be uniformly cooked. The consumer does not always possess such a utensil which is sold separately from the food. In addition, a utensil of the type in question cannot be adapted to all the various container shapes although it ought to accommodate several.

SUMMARY OF THE INVENTION

The invention enables the problems associated with known containers to be overcome by a simple means which is sold together with the food and which forms part of its pack.

The pack according to the invention is characterized in that the cover is made of a material transparent to microwaves, in that the cover forms a receptacle for a fluid which absorbs microwaves so that the container is surrounded by said fluid during heating or cooking after the cover has been inverted and the container which may be made of metal placed therein.

According to the invention, a container may be both frustopyramidal in shape with a rectangular or square base and frustoconical with a circular or oval base.

Preferred embodiments of the invention are described in detail in the following with reference to the accompanying drawings.

DETAILED DESCRIPTION OF THE DRAWINGS

Figure 1:
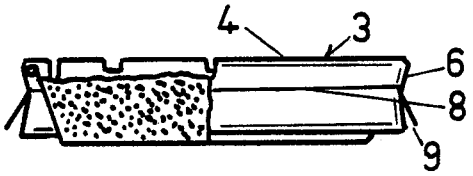
FIG. 1 is a view, half in section, of a rectangular-base container and cover before boxing.
Figure 2:
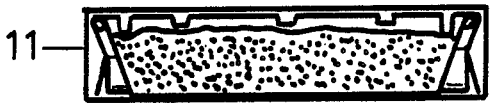
FIG. 2 is a longitudinal section through the container and cover shown in FIG. 1 in a box.

Referring to the drawings, the container 1 of aluminium, optionally lacquered on the outside, containing the frozen food 2 is provided with a cover 3 made of a material transparent to microwaves. The cover 3 may be made by folding or forming, for example of cardboard coated on its inner surface with a layer of plastics material. It may be obtained by injection or thermoforming of a plastics material or of a composite material of cardboard and plastic. The plastics material is preferably polyethylene terephthalate or polybutylene terephthalate, a polyolefin, for example polybutylene, polymethylpentene, polypropylene or high-density polyethylene, polyetherimide, polystyrene, polyvinyl chloride, polycarbonate, or suitable combinations of these materials.

The cover comprises a surface 4 of which the rounded contours are adapted to those of the upper edge 5 of the container and a continuous lateral wall 6 connected to the surface 4. In the embodiment illustrated, the lateral wall 6 initially follows the lateral wall 7 of the container, i.e., is slightly recessed. This configuration enables the cover to be engaged on the container. The beginning of the lateral wall may also be substantially perpendicular to the surface 4. The lateral wall is extended by a skirt widened to the base of the container. This skirt defines an enveloping volume sufficient to avoid unwanted arcing in cases where the metal container is close to other metal objects such as, for example, the wall of the oven or another container, during the preparation process, as will be explained hereinafter. In the particular embodiment illustrated, the lateral wall 6 comprises a score line 8 or perforations where the wall changes direction. The wall 6 comprises precut lines 9 or perforations at the corners starting from the score line 8. Precut in this way, the end of the wall defines lateral handles 10 which, at the same time, act as flexible tabs for keeping the container in the cardboard box 11, which reduces the risks of deformation during handling.

Figure 4:
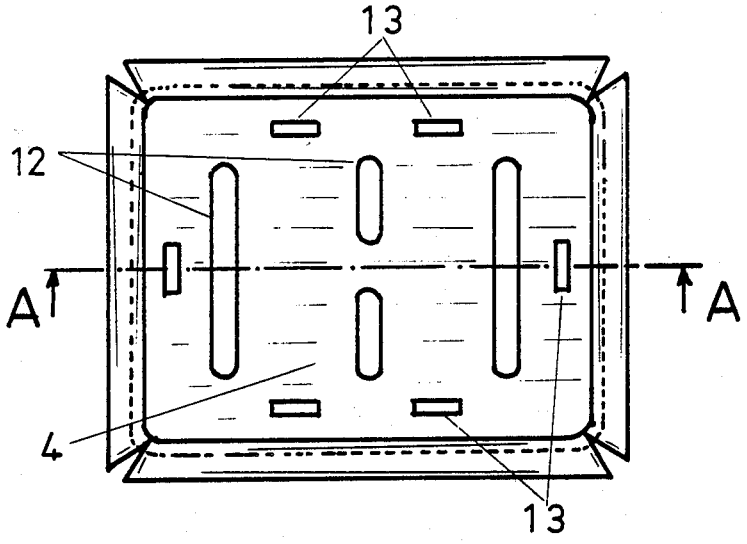
FIG. 4 is a view of the cover shown in FIG. 1 from beneath.
Figure 5:
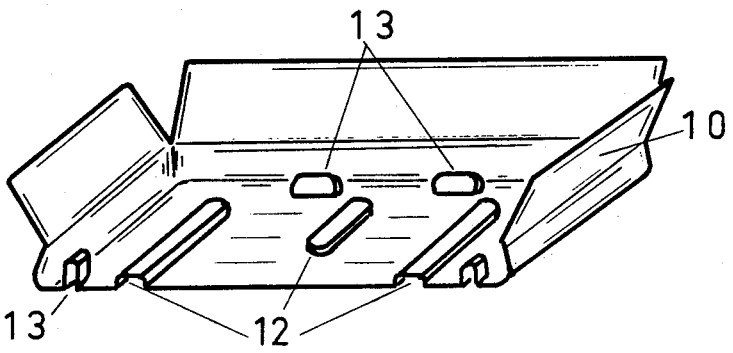
FIG. 5 is a perspective view in section on the line A—A of FIG. 4.

As shown in FIGS. 4 and 5, the cover 3 is provided with projections which form bottom spacing studs 12 and centering studs 13 for the container. In a variant (not shown), a sheet of crinkled paper capable of absorbing water is inserted between the studs 12 against the bottom of the cover. Its thickness is such that it comes to the upper level of the studs 12.

When it is desired to heat or cook the food in a microwave oven, the cover is removed and inverted. Water is then poured into the base (a) to the upper level of the studs 12, for example to 20 to 200 ml, after which the container (b) is placed between the studs 13 and the whole is placed in the oven. The cover defines a space enveloping the container and thus acts as a water bath. On completion of cooking or heating, the flexible tabs may advantageously serve as handles for removing the food from the oven. The score line 8 enables the tabs to be folded outwards to facilitate holding without any risk of burns. In cases where an absorbent sheet is arranged against the bottom of the cover, there is no danger of boiling water being spilled during removal of the dish from the oven.

Where a convection oven or infra-red oven is used, the cover is simply removed and the container is placed in the oven.

Figure 6:
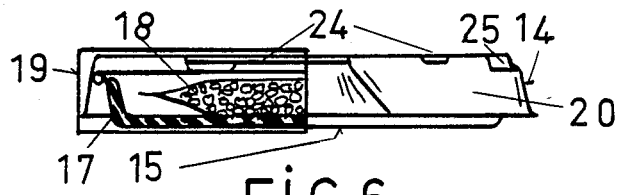
FIG. 6 is a partial view, half in section, on the line A—A of FIG. 7, of a round-bottomed container with its cover.
Figure 7:
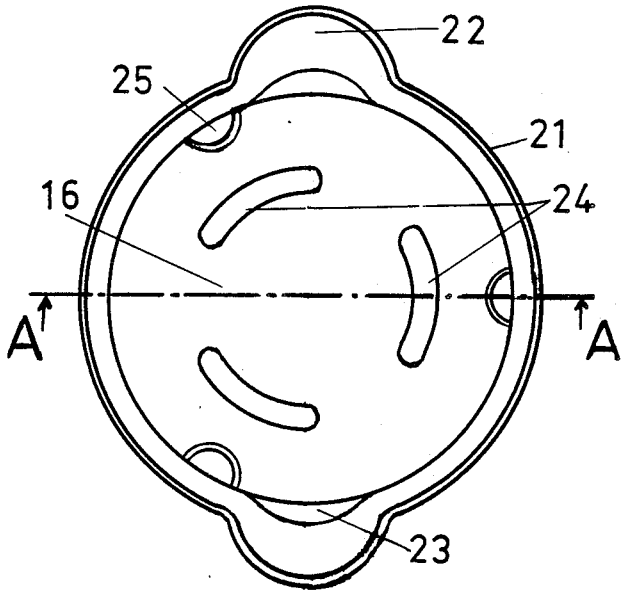
FIG. 7 is a view of the cover shown in FIG. 6 from beneath.

As shown in FIGS. 6 and 7, the cover 14 of a round-bottomed container 15 comprises a base 16 adapted in diameter to that of the upper edge of the container. The container accommodates a precooked pastry crust 17 and a bag 18 containing a dehydrated mixture which forms the filling. The container holding the pastry base, the bag and its cover are placed in a cardboard box 19. In a variant, the box 19 may be replaced by a bag, for example of polyethylene.

The cover comprises a continuous lateral face 20 and an edge 21, the lateral face and the edge defining, at two diametrically opposite points, holding tabs 22 and forming flow channels 23 for the water intended to be poured therein, as explained hereinafter. Towards the middle part of its base, the cover 14 is provided with bottom spacing studs 24 in the form of arches and notches 25 of which the height is greater than that of the studs at the level of the side wall intended to centre the container.

Figure 3:
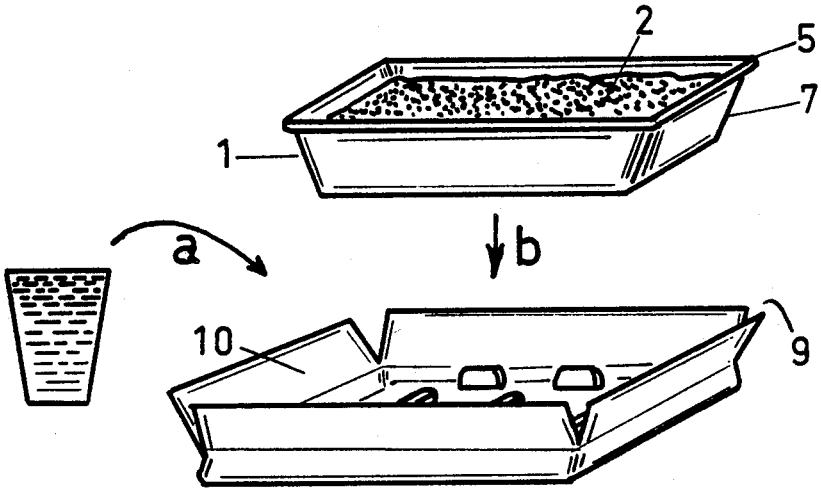
FIG. 3 diagrammatically illustrates the use of the cover shown in FIG. 1 for the preparation of a food with a view to eating.

The cover is used as described above with reference to FIG. 3, except that an additional step is involved in the separate preparation of the filling in that after opening of the bag, its contents are poured into a bowl with an egg and cold milk and mixed. After the cover has been inverted, water is poured in to the upper level of the studs 24, preferably through a channel 23, after which the container holding the precooked crust is placed between the notches 25 and the mixture forming the filling is poured into the container and the whole is then placed in a microwave oven.

The principle may of course be applied to containers of the type comprising multiple compartments. In that case, the cover covers all the compartments and, after it has been inverted, may serve as a water bath for cooking or heating all the foods contained in the various compartments.

Figure 8:
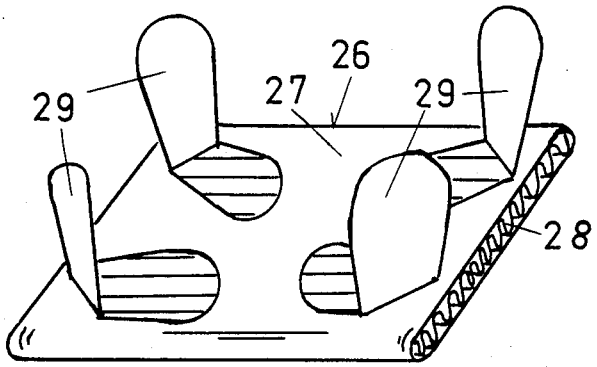
FIG. 8 is a perspective view of another cover for a container with a rectangular base.

In FIG. 8, the cover 26 is made of a cardboard 27 sealed on its inner face, for example by impregnation with polyethylene. The cardboard 27 is wrapped around a layer of absorbent crinkled paper 28. Tabs 29 disposed at angles are precut into the cardboard on the upper surface of the cover. This variant is suitable for the heating and cooking of prepared dishes deep-frozen in an aluminium container. The aluminium may optionally be lacquered on the outside.

To prepare the dish, the tabs 29 are raised, the quantity of water which the sheet 28 can absorb is poured in and the container is placed between the tabs. The dish is then placed in the microwave oven. During heating or cooking, the steam generated from the absorbed water surrounds the container and provides for uniform heating or cooking.

EXAMPLES

The following Comparative Examples 1 to 3 illustrate the performance characteristics of the pack according to the invention (1), FIG. 1, the cover being inverted, filled with the quantity of water indicated and the container accommodating the food being placed inside as described above, compared with those (2) of the aluminium container accommodating the food and (3) of a dish in a special glass for microwave ovens in which the food, having been turned out, is placed during heating for 12 minutes of various frozen cooked dishes by means of a Kenwood A414 microwave oven (460 watts restored) with turntable. In case (3), the product is turned out and then placed in the glass utensil either after having been kept for 15 mins. at −20° C. or for 15 mins. at +20° C. or directly. This additional operation is intended to study the influence of the thermal inertia of the container on the heating of the food. The temperatures are measured as soon as possible after the treatment in the oven is over.

In Comparative Example 4 below, the performance characteristics of the pack (1) according to the invention, FIG. 6, are compared with those of the aluminium container accommodating the food (2) in the preparation of a flan with a baked custard filling. The volume of the container is approximately 500 cm$^3$.

In case (1), the mixture of dehydrated ingredients of the filling, 200 cc cold milk and a whole beaten egg are poured into the container lined with a precooked pastry crust to fill approximately two thirds of the crust.

In case (2), the quantity of water indicated is poured into the inverted cover of high-density polyethylene, the container holding the crust is placed thereon and the mixture forming the filling is poured in.

In cases (1) and (2), the dish is placed for 7 minutes in a microwave oven (600 watts restored). The flan is then left for 1 to 2 minutes before tasting.

COMPARATIVE EXAMPLE 1

TABLE 1

| Product: lasagne, 509 g | (1) In a water bath containing water (g) 40 | 50 | 100 | (3) Stored at −20° C. 15 mins. | Stored at +20° C. 15 mins. | Treat immediately | (2) |
|---|---|---|---|---|---|---|---|
| Temperature at base of container °C. | 60.8 | 70.3 | 72.3 | 42.1 | 63.6 | 60.3 | 18.9 |
| Temperature at middle of container °C. | 56.6 | 55.5 | 62.8 | 35 | 46.2 | 42.2 | 42.8 |
| Temperature at surface of container °C. | 53.8 | 50.5 | 59.4 | 41.9 | 41.3 | 40.9 | 51.3 |
| Mean temperature °C. | 58.6 | 61.4 | 67.5 | 52.1 | 62.1 | 58.9 | — |
| Evaporation (g) | | | | | | | |
| of water in product | 35.6 | 16.2 | 12.9 | — | 37.1 | 39.4 | 31.8 |
| of added water | 9.6 | 21.1 | 9.2 | — | — | — | |
| Appearance | slightly coloured | | | | not coloured | | dry, part. burnt |
| Texture of pasta | correct, firm a little soft | | correct | | | | sticky, softened |

It can be seen from the results of Table 1 that the pack according to the invention (1) provides for greater uniformity of temperature than in the case of the product removed from its mould and placed in a special dish (3) whereas the temperatures are not at all uniform in (2).

The evaporation of water from the product is less in (1) than in (2) and (3), being particularly considerable when the quantity of water added is greater.

The organoleptic qualities are considerably better for (1) than for (3) and are unsatisfactory in the case of (2).

COMPARATIVE EXAMPLE 2

TABLE 2

| Product: aubergine gratin, 462 g | (1) In a water bath containing water (g) 40 | 50 | 100 cold | 100 hot | (3) Treated immediately | (2) |
|---|---|---|---|---|---|---|
| Temperature at base of container °C. | 56 | 67.5 | 77.1 | 72 | 77.1 | 32.5 |
| Temperature at middle of container °C. | 61.4 | 56.9 | 72.3 | 61 | 71.1 | 55 |
| Temperature at surface of container °C. | 74 | 58.4 | 67.8 | 60 | 68.2 | 63.2 |
| Mean temperature °C. | 64.7 | 62.6 | 74.2 | 73 | 76.9 | 49.3 |
| Evaporation (g) | | | | | | |
| of water in product | 18 | 11 | 13.6 | 16 | 35 | 39 |
| of added water | 13 | 22.4 | 9.5 | 16 | — | — |
| Appearance | Cheese slightly melted | | Pleasant appearance | | Cheese barely melted | Cheese crusty |
| Texture of gratin | Cheese a little rubbery | | Cheese melted | | Correct | Very hard, inedible |

The pack (1) provides for a uniform temperature and for less evaporation of water from the product. Whether the water added is cold or hot does not significantly affect the result. Uniformity is slightly better with cold water.

Texture and appearance in the case of (2) are totally unacceptable.

COMPARATIVE EXAMPLE 3

TABLE 3

| Product: fish with bordelaise sauce, 410 g | (1) In a water both containing water (g) 40 | 50 | 100 | (3) Treated immediately | (2) |
|---|---|---|---|---|---|
| Temperature at base of container °C. | 76.6 | 78.9 | 78.4 | 84 | 65.4 |
| Temperature at middle of container °C. | 76.7 | 71.4 | 74.5 | 79 | 74.8 |
| Temperature at surface of container °C. | 77.4 | 68.1 | 66.6 | 68 | 76.1 |
| Mean temperature °C. | 77.8 | 76.7 | 77 | 81 | 73.2 |
| Evaporation (g) | | | | | |
| of water in product | 20.5 | 16.1 | 20.7 | 40 | 42.1 |
| of added water | 8.3 | 16.9 | 15.2 | — | — |
| Appearance | Normal | | | Grey, rejection of albumin | Dull |
| Texture of fish | Cooked | | | Cooked | Undercooked |

In this case, the temperature differences are reduced because the fatty sauce circulates at the base and facilitates the transfer of heat by convection.

The evaporation of water, the appearance and the consistency of the fish are characteristically different, clearly in favour of (1).

COMPARATIVE EXAMPLE 4

TABLE 4

| Quantity of water added to the cover ($cm^3$) | Cooking time(s) at full power (600 W) | Remarks of tasting panel |
|---|---|---|
| (1) comparison without cover | 210 | Vigorous boiling of the filling at the periphery, causing compression of the baked custard at the centre. Texture of the scrambled egg type, unacceptable. |
| (2) 90 | 330 | Boiling at the periphery, virtually no more compression at the centre, ripple effect on the surface, texture not entirely smooth |
| 150 | 360 | Slight boiling at the centre, smooth texture, ripple effect on the surface |
| 150 | 420 | Uniform setting of the baked custard no ripple effect, very satisfactory texture and appearance. |

The pack according to the invention provides for the preparation of products which it would otherwise be impossible to prepare in a microwave oven. Thus, it has been found that, in the preparation of the baked custard tarts according to (1), an increase in temperature to full power is far too rapid and causes the filling to boil before it has set. The outcome is the formation of a totally unacceptable texture of the scrambled egg type. The use of reduced power, normally obtained in commercial domestic ovens by sequential emission of the waves, would not enable this problem to be overcome because it would result in movement of the fillng prejudicial to correct setting of the baked custard. Also, a scrambled egg texture would be obtained.

By contrast, the addition of a sufficient quantity of water to the inverted cover as in (2) enables the load in the microwave oven to be increased for a fixed quantity of food. This regularizes the temperature increase rate to full power which provides for better distribution of the energy in space. The layer of water is mobile and provides for the radial transfer of heat at a rapid rate compared with the slow transfer in the more viscous medium of the filling. The effect obtained is a uniform temperature leading to correct setting of the baked custard before the filling begins to boil. Finally, the conversion by the water of the water bath of part of the microwave energy into conventional heat provides for heating of the precooked crust which, because it is dry, is not sensitive to microwave radiation.

I claim:

1. A food package comprising a container for food and a cover covering a first surface of the container, the cover being made of a material transparent to microwaves, being removably connected to the container and having a receptacle adjacent the first surface of the container for containing and for surrounding a second surface of the container opposite the first surface with a fluid which absorbs microwaves.

2. A food package according to claim 1 wherein the receptable contains absorbent crinkled paper for containing the fluid which is covered by a water-proofed cardboard cover surface having tabs displaceable from a remainder of the cardboard cover surface for exposing the absorbent material and being positioned for holding the second container surface.

3. A food package according to claim 1 wherein the container has a continuous lateral wall extending from the first container surface to the second container surface and wherein the cover has a continuous lateral wall positioned adjacent the container lateral wall.

4. A food package according to claim 3 wherein studs project from a receptacle cover surface into the receptacle for providing a base for placing and holding the second container surface and thereby forming a cavity for the fluid between the second container surface and the receptacle cover surface.

5. A food package according to claim 3 wherein the cover lateral wall extends, at a point between the first and second container surfaces, away from the container lateral wall to form a skirt about the container lateral wall.

6. A food package according to claim 5 wherein the skirt contains score lines for defining handles and flexible tabs.

7. A food package according to claim 1 wherein studs project from a receptacle cover surface into the receptacle for providing a base for placing and holding the second container surface and thereby forming a cavity for the fluid between the second container surface and the receptacle cover surface.

8. A food package according to claim 7 wherein further studs project from the receptacle cover surface into the receptacle and are positioned for centering the container with respect to the receptacle.

9. A food package according to claim 7 wherein the receptacle contains absorbent crinkled paper between the studs for containing the fluid.

10. A food package according to claim 1 wherein the container has a shape of a frustopyramid such that the first container surface is a top surface of the frustopyramid and the second surface is a base of the frustopyramid having dimensions and an area smaller than the first surface.

11. A food package according to claim 1 wherein the container has a shape of a frustocone such that the first container surface is a top surface of the frustocone and the second surface is a base of the frustocone having dimensions and an area smaller than the first surface.

12. A food package according to claim 1 wherein the cover is made of water-proofed cardboard.

13. A food package according to claim 1 wherein the cover is made of plastic.

14. A food package according to claim 1 wherein the container is made of metal.

15. A food package comprising a container having a base surface and a continuous lateral wall extending to a top of the container and comprising a cover made of a microwave transparent material having inner and outer surfaces extending to a continuous lateral wall, being formed for enclosing the top of the container and being removable from the container and having a receptacle associated with the inner surface adjacent the top of the container for containing and for surrounding the container base surface with a fluid which absorbs microwaves.

16. A food package according to claim 15 wherein studs project from the inner cover surface into the receptacle for providing a base for placing and holding the container base and thereby forming a cavity for the fluid between the container base and the inner cover surface.

17. A food package according to claim 15 wherein further studs project from the inner cover surface into the receptacle and are positioned for centering the container with respect to the receptacle.

18. A food package according to claim 15 wherein the cover lateral wall extends, at a point between the container top and base, away from the container lateral wall to form a skirt about the container lateral wall.

19. A food package according to claim 18 wherein the skirt contains score lines for defining handles and flexible tabs.

20. A food package according to claim 14 wherein the container is made of metal.

* * * * *

UNITED STATES PATENT AND TRADEMARK OFFICE

CERTIFICATE OF CORRECTION

PATENT NO. : 4,916,280

DATED : April 10, 1990

INVENTOR(S) : Bernard HAVETTE

It is certified that error appears in the above-identified patent and that said Letters Patent is hereby corrected as shown below:

Column 8, line 20, (line 2 of claim 2), "receptable" should read --receptacle--.

Column 10, line 27, (line 1 of claim 27, (line 1 of claim 20), "14" should read --15--.

Signed and Sealed this

Twenty-sixth Day of March, 1991

*Attest:*

HARRY F. MANBECK, JR.

*Attesting Officer*

*Commissioner of Patents and Trademarks*